US005344198A

United States Patent [19]

Elliott

[11] Patent Number: 5,344,198

[45] Date of Patent: Sep. 6, 1994

[54] FRAME STRENGTHENING APPARATUS AND METHOD

[76] Inventor: Roy L. Elliott, P.O. Box 56765, Houston, Tex. 77256

[21] Appl. No.: 155,093

[22] Filed: Nov. 19, 1993

Related U.S. Application Data

[63] Continuation of Ser. No. 955,277, Oct. 1, 1992, abandoned.

[51] Int. Cl.[5] ..... E05B 15/02

[52] U.S. Cl. ..... 292/340; 292/346; 49/460; 52/514

[58] Field of Search ..... 292/340, 346; 49/462, 49/460, 504; 52/514

[56] References Cited

U.S. PATENT DOCUMENTS

| | | | |
|---|---|---|---|
| 2,470,514 | 5/1949 | Muller | 52/514 |
| 2,533,396 | 12/1950 | Payne | 292/340 |
| 2,793,894 | 5/1957 | Modes | 292/340 X |
| 3,556,573 | 1/1971 | Miller | 292/143 |
| 3,888,530 | 6/1975 | Fabrici | 292/346 X |
| 4,060,267 | 11/1977 | Monfardini | 292/173 |
| 4,098,101 | 7/1978 | Svoboda | 70/134 |
| 4,113,291 | 9/1978 | Cameron | 292/40 |
| 4,199,176 | 4/1980 | Kelly | 292/38 |
| 4,227,723 | 10/1980 | Rosell | 292/34 |
| 4,231,597 | 11/1980 | Pelcin | 292/164 |
| 4,261,602 | 4/1981 | Anderson | 292/143 |
| 4,315,647 | 2/1982 | Wilzig et al. | 292/143 |
| 4,315,648 | 2/1982 | Labelle | 292/150 |
| 4,369,994 | 1/1983 | Vorves | 292/340 |
| 4,387,917 | 6/1983 | Cocker | 292/40 |
| 4,390,199 | 6/1983 | Taylor | 292/346 |
| 4,416,087 | 11/1983 | Ghatak | 292/346 X |
| 4,489,576 | 12/1984 | Mullich et al. | 70/134 |
| 4,512,597 | 4/1985 | Nabb et al. | 292/143 |
| 4,601,499 | 7/1986 | Kim | 292/36 |
| 4,640,052 | 2/1987 | Zebedee et al. | 49/460 X |
| 4,674,776 | 6/1987 | James | 292/40 |
| 4,773,682 | 9/1988 | Saelzer | 292/143 |
| 4,815,774 | 3/1989 | Correnti | 292/145 |
| 4,844,521 | 7/1989 | Langenbach et al. | 292/143 |
| 4,878,699 | 11/1989 | Wronski | 292/143 |
| 4,915,430 | 4/1990 | Vitale | 292/145 |
| 4,986,576 | 1/1991 | Anderson | 292/40 |
| 5,029,909 | 7/1991 | Bunger | 292/40 |
| 5,029,912 | 7/1991 | Gotanda | 292/143 |
| 5,080,354 | 1/1992 | McDougall | 292/145 |
| 5,094,485 | 3/1992 | Lycett | 292/143 |

*Primary Examiner*—Rodney M. Lindsey
*Attorney, Agent, or Firm*—Gregory L. Maag

[57] ABSTRACT

A simple, inexpensive and effective apparatus and method for strengthening a door frame or similar structure to make the frame less susceptible to being broken when the door is subjected to a violent blow or kick. According to the invention, a fastener is disposed through the doorjamb on each side of the bore that is formed in the facing surface of the doorjamb for receiving the bolt of a deadbolt lock or other latching device. The fasteners are disposed through the doorjamb in bores formed generally perpendicular to the edges of the doorjamb and parallel to the plane formed by the facing surface of the doorjamb. A rigid member connects the fasteners on the inside edge of the doorjamb to provide increased strength to the section of the doorjamb located adjacent to the deadbolt.

20 Claims, 2 Drawing Sheets

FRAME STRENGTHENING APPARATUS AND METHOD

This is a continuation of copending application Ser. No. 07/955,277 filed on Oct. 1, 1992 now abandoned.

BACKGROUND OF THE INVENTION

This invention relates generally to doors and door frames and, in particular, to wooden doors and door frames. Still more particularly, the invention relates to apparatus and method designed to strengthen the door frame at locations where the doorjamb includes a bore for receiving a deadbolt of a deadbolt lock or the latch bolt of a lock set.

Hinged doors mounted on wooden frames are commonly employed in homes, motel and hotel rooms, as well as other dwellings and offices where a significant measure of security is desirable. Typically, these doors are hinged so as to open inwardly into the interior of the room making them vulnerable to being kicked, pried or forced open. Such doors are typically latched in a closed position by means of a lock set which includes a latch bolt that automatically extends when the door is closed into an aligned bore formed in the doorjamb. For additional security, it is typical for the door to include a deadbolt lock which includes a straight deadbolt mounted in the door adjacent to another aligned bore formed in the doorjamb. The deadbolt is moved into the locked position in the bore by turning a handle on the inside portion of the lock, or by inserting and turning a key in the lock.

In typical frame construction, the doorjamb may be formed of a relatively thin piece of wood, frequently less than 1 inch thick. The bore formed in the doorjamb for either the deadbolt or the latch bolt may extend either partially or totally through the thickness of the doorjamb. In either instance, because the wood used in forming the doorjamb is typically a relatively soft wood, such as pine, and because the bores are frequently formed only a few inches from the edge of the doorjamb, it is not difficult for burglars or others with criminal intentions to break the doorjamb at locations adjacent to the bores by a simple kick or firm blow to the outside of the door. The force applied to the outside of the door is transmitted through the deadbolt and the latch bolt to the doorjamb which is substantially weakened by the bores.

There are a number of approaches taken in trying to make doors and door frames more secure. First, it is known to increase the length of the deadbolt and, thus, to increase the depth to which the deadbolt extends into the doorjamb. Further, it is known to provide metal strike plates having an aperture disposed about the bore holes for receiving the deadbolt or latch bolt of the lock set. Further, in attaching the strike plate to the doorjamb, it is known to use screws having a substantial length so that the screws will penetrate not only the doorjamb, but also a vertical stud positioned behind the doorjamb.

These various techniques no doubt provide some additional measure of security. Nevertheless, it is not uncommon for a firm blow or kick to the door to break out that portion of the door frame adjacent to the deadbolt lock or lock set even with these extra precautions. Accordingly, despite the benefits provided by longer deadbolts and reinforced bore holes, an additional or more effective means for strengthening a door frame adjacent to a lock and lock set would be a welcomed addition to the art. Apparatus for strengthening the door frame which is simple to install and comprised of inexpensive and readily available components would be especially desirable.

SUMMARY OF THE INVENTION

The present invention substantially advances the technology relating to locks and latching devices on hinged doors. The invention provides a means for increasing security by reinforcing door frames so as to lessen the likelihood of the doors being kicked or forced open. The invention generally includes a doorjamb having a facing surface, a pair of edge surfaces adjacent to the facing surface, and a bore formed in the facing surface for receiving the bolt of a deadbolt lock or a latch bolt of a lock set. The invention further includes a first and a second member for compressing the doorjamb in a direction substantially perpendicular to the axis of the bore, these members being disposed on opposite sides of the bore. In one embodiment of the invention, the members comprise carriage bolts disposed through bores which are formed in the doorjamb along axes that are substantially perpendicular to the edges of the doorjamb. A rigid plate member generally aligned with the inside edge of the doorjamb includes apertures aligned with the bores. The apertures are disposed about the ends of the carriage bolts and connected thereto by cap nuts and lock washers. In another embodiment, the invention comprises a base member having a pair of extending and spaced-apart legs which are disposed through the doorjamb in bores substantially perpendicular to the edges of the doorjamb. The legs include threaded ends which are disposed through apertures in a rigid plate that is generally aligned with the inside edge of the doorjamb. The plate is connected to the legs by nuts and lock washers. In both of these embodiments, the compressive force that is cooperatively supplied by the fasteners and the plate member provides extra strength and integrity to the doorjamb at the location adjacent to the deadbolt or latch bolt, a portion of the door frame which is otherwise vulnerable to being broken away by a blow to the door.

The invention may alternatively include a pair of subassemblies of flange nuts and threaded bolts which are disposed through the edges of the doorjamb on opposite sides of the bore that is formed in the facing surface of the doorjamb. The flange nuts include a flange section connected to a sleeve portion extending therefrom and having a threaded bore. The sleeve portion of each nut is disposed in a first bore substantially perpendicular to one edge of the doorjamb. A second coaxially aligned bore is formed through the opposite edge of the doorjamb so as to intersect with the first bore. A bolt is disposed through each set of aligned bores and threadingly engages the corresponding flange nut. When the bolts are tightened, the bolts and flange nuts provide a compressive force and reinforcement for the doorjamb at a location adjacent to the bore for the deadbolt or latch bolt.

Another embodiment of the invention includes an elongate reinforcing member having a base and a pair of extensions projecting substantially perpendicularly from the base. The extensions each include a threaded bore. The extensions are disposed in a pair of first bores formed in one edge of the doorjamb. Each of these first bores is coaxially aligned with and intersects one of a pair of second bores formed in the opposite edges of the doorjamb. Bolts are disposed through the aligned bores and threadingly engage the extensions in the reinforcing member, the bolts being tightened until a substantial compressive force is applied to the doorjamb in a direction generally perpendicular to the edges of the doorjamb.

Thus, the present invention comprises features and advantages which enable it to substantially advance the art and technology associated with securing hinged doors. The invention is comprised of a combination of elements which simply and inexpensively provide substantial reinforcement to the door frame, reinforcement that is supplied by a compressive force which will oppose the force applied when someone attempts to force the door open by a kick or violent blow. The invention is inexpensive, highly effective, and easy to install. These and various other characteristics and advantages of the present invention will be readily apparent to those skilled in the art upon reading the following detailed description and referring to the accompanying drawings.

BRIEF DESCRIPTION OF THE DRAWINGS

For an introduction to the detailed description of the preferred embodiments of the invention, reference will now be made to the accompanying drawings, wherein.

DESCRIPTION OF PREFERRED EMBODIMENT

Figure 1:
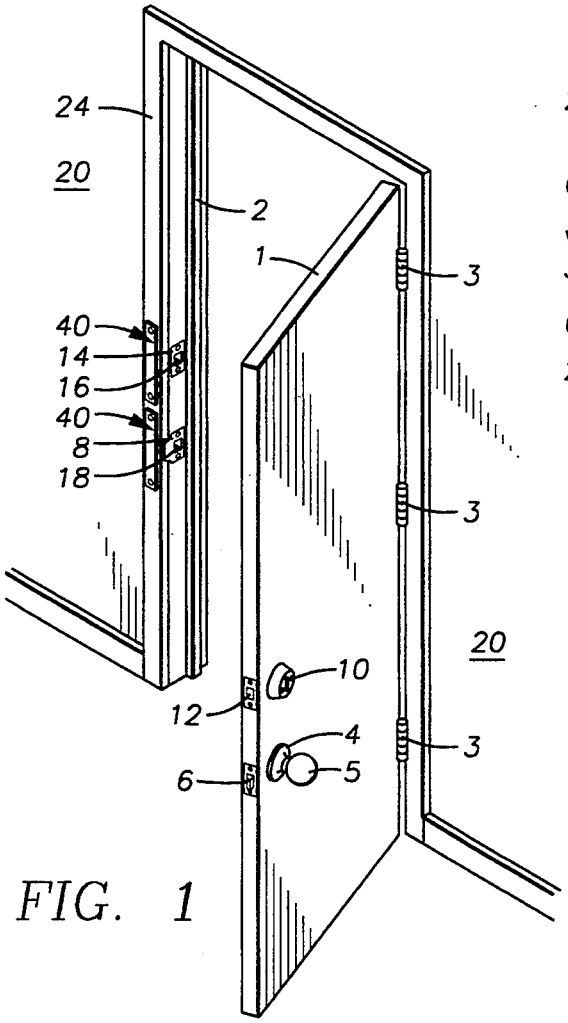
FIG. 1 shows a perspective view of a door and door frame incorporating the frame strengthening apparatus of the present invention.

Referring initially to FIG. 1, the frame strengthening apparatus 40 of the present invention is shown employed in conjunction with a conventional, inwardly opening door and door frame as typically found in homes, apartments, hotels and motels, offices, and other dwelling and work places. As shown in FIG. 1, door 1 is formed in interior wall 20 and mounted within door frame 2 by hinges 3. Door 1 includes a latching apparatus such as lock set 4 having knob 5 and latch bolt 6. Door 1 further includes a second latching apparatus such as deadbolt lock 10 which includes a reciprocating bolt 12. Bores 16 and 18 are formed in door frame 2 for receiving bolt 12 and latch bolt 6 when door 1 is closed. Plates 8 and 14 each include a central aperture 15 and are fastened into the door frame 2 opposite lock set 4 and deadbolt lock 10, respectively, with each aperture 15 aligned with one of bores 16 and 18. Trim member 24 is disposed about door frame 2 and covers the joint formed by the intersection of door frame 2 and interior wall 20.

In the preferred embodiment, frame strengthening apparatus 40 is disposed through door frame 2 adjacent each latching apparatus, such as lock set 4 and deadbolt lock 10 as shown in FIG. 1. The structure and operation of frame strengthening apparatus 40 is the same regardless of the type of latching apparatus. Accordingly, the remainder of this description of the preferred embodiments will be described with reference to deadbolt lock 10, it being understood by those skilled in the art that the invention is equally applicable to use with lock set 4 and other latching apparatus.

Figure 2:
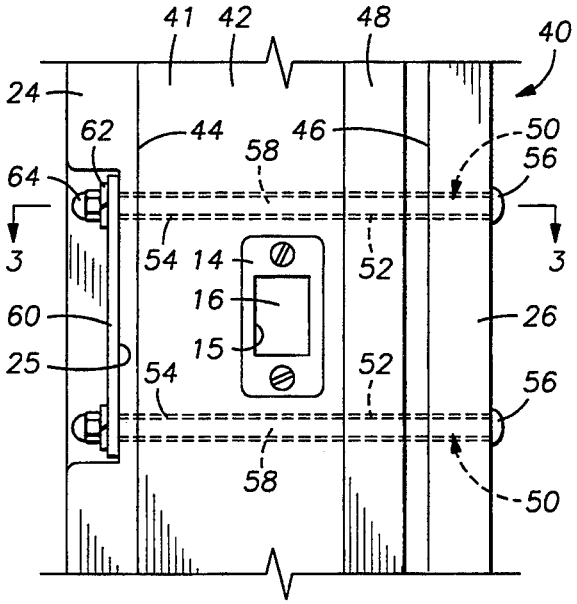
FIG. 2 shows an enlarged elevational view of the present invention shown in FIG. 1.
Figure 3:
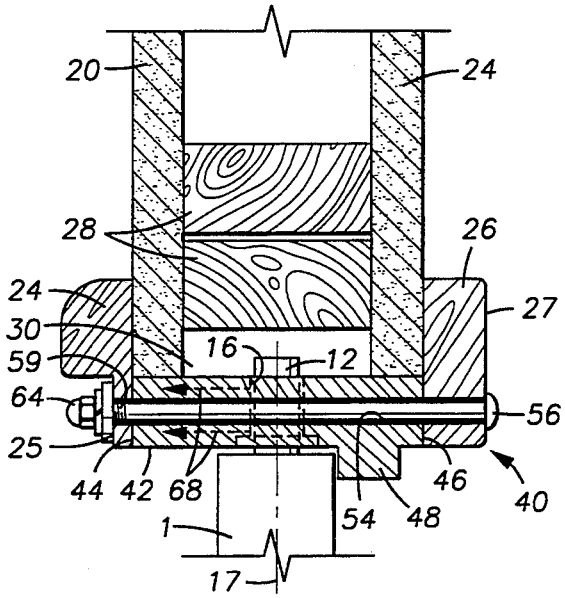
FIG. 3 shows a cross-sectional view of the frame strengthening apparatus of the present invention shown at 3—3 in FIG. 2.

Referring now to FIG. 2, door frame 2 includes doorjamb 41 having facing surface 42 and a raised stop member 48. Stop member 48 may be integrally formed in doorjamb 41 or, alternatively, may be a separate piece nailed or otherwise suitably attached to facing surface 42. Doorjamb 41 further comprises edge surfaces 44, 46 which are adjacent and generally perpendicular to facing surface 42, as best shown in FIG. 3. Doorjamb 41 may be made of wood, such as what is conventionally known as a 1"×6" board.

Referring to FIGS. 2 and 3, opposite interior wall 20 is exterior wall 24. Walls 20 and 24 are generally supported by and fastened to vertical braces 28 and 29. Doorjamb 41 of door frame 2 is disposed adjacent the ends of interior wall 20 and exterior wall 24 and may be fastened to brace 28 and walls 20, 24 by nails or other suitable fasteners. A cavity 30 is formed between doorjamb 41, brace 28, and walls 20, 24. Interior trim member 24 is disposed against interior wall 20 so as to cover edge 44 of doorjamb 41. Likewise, exterior trim member 26 is disposed against exterior wall 24 and covers edge 46 of doorjamb 41. In conventional wood frame construction, as shown in FIG. 3, trim members 24 and 26 are nailed to doorjamb 41 or walls 20, 24, or both.

Doorjamb 41 includes a pair of generally parallel bores 54 formed through doorjamb 41 generally perpendicular to edge surfaces 44, 46 and generally parallel to the plane formed by facing surface 42. Preferably, bores 54 are spaced approximately 3 to 4 inches apart. Bore 16 for receiving bolt 12 of deadbolt lock 10 includes a central axis 17 and is formed substantially perpendicular to facing surface 42 at a location between bores 54. Fasteners 50 are disposed through bores 54 and employed to provide a compressive force to doorjamb 41 in a direction substantially perpendicular to edge surfaces 44, 46 and to axis 17 of bore 16.

In a preferred embodiment, fasteners 50 comprise carriage bolts 52 as shown in FIGS. 2 and 3. Carriage bolts 52 are preferably approximately ¼ to ⅜" in diameter and include head 56 and shank portion 58, shank 58 including threaded end 59. Carriage bolts 52 are disposed in bores 54 with heads 56 adjacent outside wall 24 and with threaded ends 59 extending beyond edge surface 44 of doorjamb 41 and beyond recessed surface 25 of interior trim member 24. Although not shown, if desired, heads 56 may be countersunk or otherwise recessed into surface 27 of exterior trim member 26. In such an installation, a decorative plate or another trim member may be fastened to surface 27 of trim member 26 to conceal heads 56.

Figure 4:
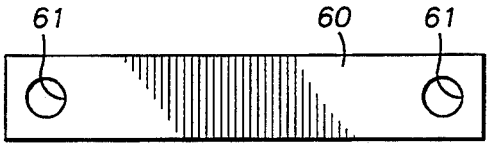
FIG. 4 shows a plan view of the connecting plate shown in FIGS. 2 and 3.

Frame strengthening apparatus further includes connecting plate 60. Referring briefly to FIG. 4, connecting plate 60 is preferably formed of a rigid metal such as steel or brass, and is at least approximately 1/16" to ⅛" thick. Plate 60 includes a pair of apertures 61 for receiving threaded ends 59 of carriage bolts 52. In the preferred embodiment, the width of plate 60 is approximately equal to the width of edge surface 44 of doorjamb 41. As shown best in FIG. 2, connecting plate 60 is disposed against recessed surface 25 of interior trim member 24 with apertures 61 aligned with bores 54. Threaded ends 59 of carriage bolts 52 are disposed through apertures 61 of connecting plate 60. A lock washer 62 and cap nut 64 is positioned about threaded end 59 of each carriage bolt 52 and cap nut 64 is tightened to apply compressive force to doorjamb 41 in the region adjacent to bore 16 to make doorjamb 41 more resistant to forces applied to it in the direction denoted by arrows 68 in FIG. 3. The compressive force cooperatively supplied by fasteners 50 and connecting plate 60 provide greatly increased strength to doorjamb 41 which is frequently made of pine or other soft wood which can otherwise be easily split or broken out by a kick or sharp blow to the outside surface of the door 1.

Figure 9:
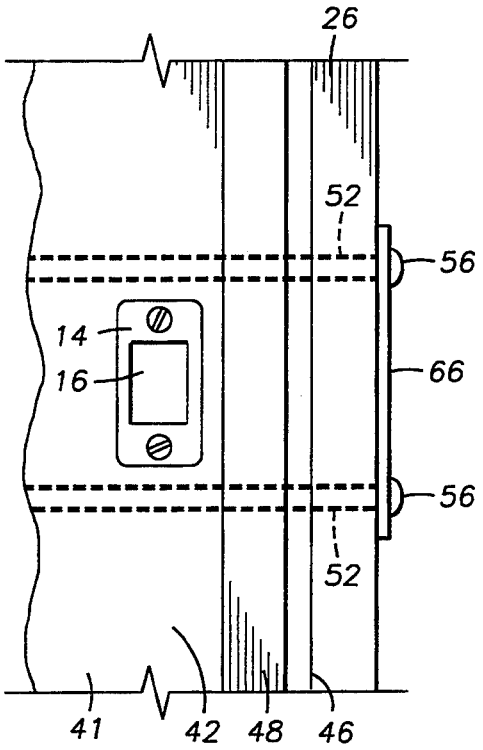
FIG. 9 shows another alternative embodiment of the invention of FIG. 2.

Referring briefly to FIG. 9, frame strengthening apparatus 40 may further include a second connecting plate 66, identical to connecting plate 60 previously described, disposed between carriage bolts 52 adjacent bolt heads 56. In this arrangement, plate 66 is generally aligned with connecting plate 60 and with edge surfaces 44 and 46 of doorjamb 41. The addition of plate 66 to frame strengthening apparatus 40 provides further strength to doorjamb 41 and door frame 2 adjacent to bore 16. If desired, plate 66 and bolt heads 56 may be recessed within a bore or channel formed in exterior trim member 26 as previously depicted in FIG. 2 with respect to plate 60.

Figure 5:
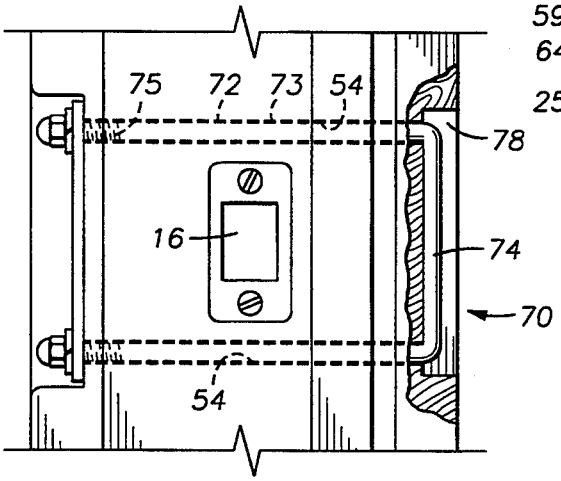
FIG. 5 shows an alternative embodiment of the present invention, partially in cross-section.

An alternative embodiment of the present invention is shown in FIG. 5. As shown in FIG. 5, frame strengthening apparatus 70 comprises bores 54 disposed through doorjamb 41 on either side of bore 16 as previously described with reference to FIG. 2. Frame strengthening apparatus 70 further includes fastener 72 having a pair of legs 73 interconnected by base portion 74. Legs 73 are disposed through bores 54 and base 74 is received in recess 78 formed in exterior trim member 26. Legs 73 include threaded sections 75 which are disposed through apertures 61 of connecting plate 60, previously described. Cap nut 64 and lock washer 62 are disposed about and tightened on the threaded ends of each leg 73. As described above with reference to FIGS. 2 and 3, the compressive force cooperatively supplied by cap nuts 64, lock washer 62, connecting plate 60 and, in this embodiment, fastener 72, strengthens and reinforces doorjamb 41.

Figure 6:
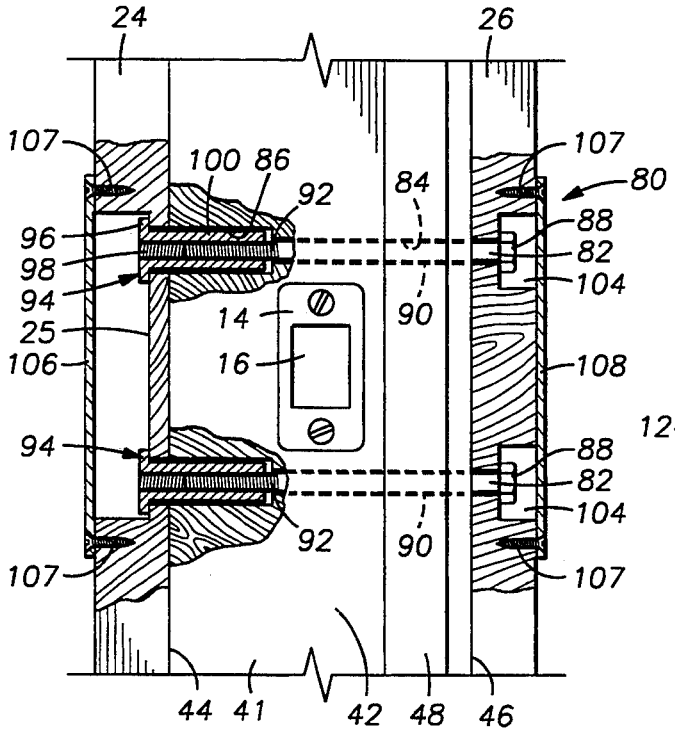
FIG. 6 Shows a partial cross-sectional view of another alternative embodiment of the present invention.

Another alternative embodiment of the present invention is shown in FIG. 6. As shown, frame strengthening apparatus 80 generally comprises a pair of bolts 82 and a pair of flange nuts 94. Bolts 82 include head 88, shank 90, and threaded end portions 92. In this embodiment, doorjamb 41 includes a first pair of bores 86 formed generally perpendicularly through inside edge surface 44, and a second pair of bores 84 formed generally perpendicularly through outside edge surface 46, bores 84 being coaxially aligned and intersecting bores 86.

Flange nuts 94 include sleeve portion 100 connected to flange 96, sleeve 100 and flange 96 including a threaded bore 98. Sleeve 100 is preferably approximately 1–1½ inches in length and is disposed in bore 86 to the depth permitted by flange 96 which engages recessed surface 25 of interior trim member 24. Threaded end 92 of bolt 82 is sized so as to threadingly engage bore 98 of sleeve portion 100 of flange nut 94. Head 88 of bolt 82 is disposed in recess 104 of exterior trim member 26 and is tightened so that bolt 82 and flange nut 94 cooperate to supply compressive force to doorjamb 41 in a direction perpendicular to bore 16 which is disposed between bolts 82. To render the installation more attractive, plates 106 and 108 are fastened to interior and exterior trim members 24 and 26, respectively, by screws 107. Preferably, plates 106 and 108 are made of brass or any other attractive metal, wood or plastic.

Figure 8:
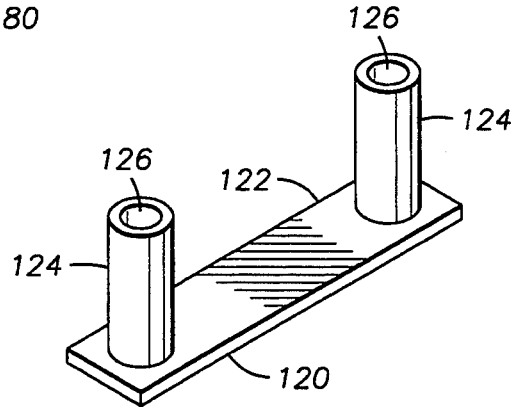
FIG. 8 shows a perspective view of the reinforcing member of the alternative embodiment of FIG. 7.
Figure 7:
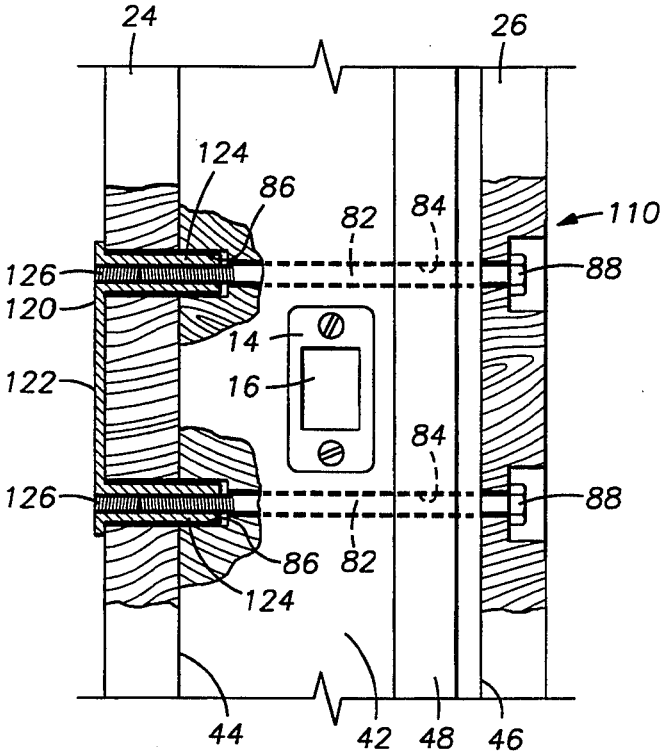
FIG. 7 shows still another alternative embodiment of the present invention, partially in cross-section.

A further alternative embodiment is shown in FIG. 7. In this embodiment, frame strengthening apparatus 110 includes a pair of bolts 82 and aligned bores 86 and 84, all as previously described with reference to FIG. 6. Apparatus 110 further comprises reinforcing member 120, best shown in FIG. 8. As shown, reinforcing member 120 includes base 122 and a pair of extensions 124. Extensions 124 each include a central threaded bore 126 adapted for threadingly engaging threaded end 92 of bolt 82. Reinforcing member 120 is preferably made of steel, brass or other rigid material. Extensions 124 are preferably 1 to 1½ inches long and spaced 3 inches apart. Base 120 is preferably approximately 1/16 to ⅛ inches thick, 4½ inches long, and one inch wide. Bolts 82 are tightened in threaded extensions 124 of reinforcing member 120 to apply a compressive force to reinforce the portion of doorjamb 41 adjacent to bore 16.

While the preferred embodiments of this invention have been shown and described, modifications thereof can be made by one skilled in the art without departing from the spirit of the invention. The embodiments described herein are exemplary only and are not limiting. Many variations and modifications of the system and apparatus are possible and are within the scope of the invention. Accordingly, the scope of protection is not limited by the above description, but is only limited by the claims which follow, that scope including all equivalents of the subject matter of the claims.

What is claimed is:

1. Frame strengthening apparatus, comprising:

a doorjamb having a facing surface adjacent to an unhinged edge of a hinged door and a pair of outer edge surfaces adjacent to said facing surface, said outer edge surfaces defining the width of said doorjamb;

a bore formed in said facing surface of said doorjamb, said bore having an axis generally perpendicular to said facing surface;

a first means for compressing said pair of outer edge surfaces of said doorjamb in a direction substantially perpendicular to said axis;

a second means for compressing said pair of outer edge surfaces of said doorjamb in a direction substantially perpendicular to said axis;

wherein said first and second compressing means are disposed on opposite sides of said bore and clamp the entire width of said doorjamb.

2. The apparatus of claim 1 wherein said first and second compressing means comprise threaded member disposed through each of said pair of outer edge surfaces of said doorjamb.

3. The apparatus of claim 2, further comprising a plate connected between said threaded members.

4. The apparatus of claim 3 wherein said plate includes extensions having threaded bores engaging said threaded members.

5. The apparatus of claim 2, further comprising flange nuts tightened about said threaded members.

6. The apparatus of claim 2 wherein said threaded members are each attached at one end to an integrally-formed interconnecting base portion, said base portion and said threaded members comprising a U-bolt.

7. The apparatus of claim 6 further comprising a plate connected between said threaded members adjacent their unattached ends.

8. An improved frame, comprising:

a doorjamb having a facing surface and a pair of outer edge surfaces generally perpendicular to said facing surface, said outer edge surfaces defining the width of said doorjamb and comprising an inside edge surface and an outside edge surface;

a first rigid member having a first end disposed through both of said outer edge surfaces of said doorjamb;

a second rigid member having a first end disposed through both of said outer edge surfaces of said doorjamb and spaced apart a distance from said first rigid member;

a plate member disposed adjacent to said first ends of said first and second rigid members and connecting said first and second rigid members.

9. The frame of claim 8 further comprising a bore formed in said facing surface of said doorjamb at a location between said first and second rigid members.

10. The frame of claim 9 wherein said plate member includes a pair of apertures and wherein said first ends of said rigid members are disposed through said apertures.

11. The frame of claim 10 wherein said first and second rigid members comprise carriage bolts having a rounded head formed at one end and a threaded portion formed on the opposite end, and wherein said bolts are disposed through said doorjamb with said rounded heads being closer to said outside edge surface than to said inside edge surface.

12. The frame of claim 8 further comprising a second plate member connecting said first and second rigid members, said second plate member being disposed generally parallel to and aligned with said outside edge surface of said doorjamb.

13. The frame of claim 8 wherein said first and second rigid members are interconnected by an integrally-formed base portion at ends opposite said first ends, said rigid members and said base portion comprising a U-bolt.

14. The frame of claim 8 wherein said plate member is generally parallel to and aligned with said inside edge surface of said doorjamb.

15. Frame strengthening apparatus, comprising:

a door frame;

a door hinged on said door frame and adapted to swing between an open and a closed position;

a latching apparatus disposed in said door, said latching apparatus including a latch member slidingly disposed between an extended position and a contracted position;

a frame member of said door frame having a facing surface and a pair of outer edge surfaces generally perpendicular to said facing surface, said outer edge surfaces defining the width of said frame member;

a trim member disposed against at least one of said outer edge surfaces of said frame member;

a first fastener disposed through both of said pair of outer edge surfaces of said frame member and through said trim member;

a second fastener disposed through both of said pair of outer edge surfaces of said frame member and through said trim member and spaced apart from said first fastener;

a bore formed in said facing surface of said frame member at a location between said first and second fasteners, for receiving said latch member when said latch member is in said extended position; and a plate member disposed generally parallel to one of said outer edge surfaces and connecting said first and second fasteners.

16. The apparatus of claim 15 wherein said plate member includes a pair of apertures for receiving said first and second fasteners.

17. The apparatus of claim 15 wherein said plate member includes a pair of extending portions having threaded bores for receiving said first and second fasteners.

18. The apparatus of claim 15 wherein said fasteners comprise carriage bolts.

19. The apparatus of claim 18 further comprising a second plate member disposed generally parallel to the other of said outer edge surfaces and connecting said first and second fasteners.

20. A method for strengthening a door frame, comprising the steps of:

providing a doorjamb having a facing surface and a pair of outer edge surfaces adjacent to said facing surface and defining the width of said doorjamb;

forming a first bore into said facing surface for receiving a latching device of a latching apparatus;

forming a second bore through both of said pair of outer edge surfaces of said doorjamb above said first bore;

forming a third bore through both of said pair of outer edge surfaces of said doorjamb below said first bore;

disposing a fastener through each of said second and third bores;

connecting a plate between said fasteners;

tightening said fasteners to clamp the entire width of said doorjamb above and below said first bore.

* * * * *